US008537642B2

(12) United States Patent
Karapatis et al.

(10) Patent No.: US 8,537,642 B2
(45) Date of Patent: Sep. 17, 2013

(54) WATCH STRIKING MECHANISM

(75) Inventors: Nakis Karapatis, Premier (CH); Davide Sarchi, Renens (CH)

(73) Assignee: Montres Breuguet SA, L'abbaye (CH)

( * ) Notice: Subject to any disclaimer, the term of this patent is extended or adjusted under 35 U.S.C. 154(b) by 104 days.

(21) Appl. No.: 13/310,229

(22) Filed: Dec. 2, 2011

(65) Prior Publication Data

US 2012/0155227 A1 Jun. 21, 2012

(30) Foreign Application Priority Data

Dec. 10, 2010 (EP) ..... 10194573

(51) Int. Cl.
*G04B 21/00* (2006.01)

(52) U.S. Cl.
USPC ..... 368/243; 368/315; 368/267; 368/269; 368/100

(58) Field of Classification Search
USPC ..... 368/100, 243, 267, 269, 315, 126
See application file for complete search history.

(56) References Cited

U.S. PATENT DOCUMENTS

| | | | | |
|---|---|---|---|---|
| 2,008,745 | A * | 7/1935 | Carlson et al. | 340/393.4 |
| 2,094,989 | A * | 10/1937 | Kohlhagen | 368/254 |
| 3,462,943 | A * | 8/1969 | Spadini et al. | 368/244 |
| 4,247,933 | A * | 1/1981 | Nakamura | 368/269 |
| 4,276,625 | A * | 6/1981 | Broghammer et al. | 368/75 |
| 2010/0232262 | A1* | 9/2010 | Morata et al. | 368/315 |
| 2011/0158058 | A1* | 6/2011 | Marechal et al. | 368/243 |
| 2011/0211426 | A1* | 9/2011 | Favre et al. | 368/243 |

FOREIGN PATENT DOCUMENTS

| | | |
|---|---|---|
| EP | 2 048 548 A2 | 4/2009 |
| FR | 1 214 428 A | 4/1960 |
| FR | 2 408 862 A2 | 6/1979 |

OTHER PUBLICATIONS

European Search Report of EP 10 19 4573 dated Jun. 24, 2011.

* cited by examiner

*Primary Examiner* — Amy Johnson
*Assistant Examiner* — Matthew Powell
(74) *Attorney, Agent, or Firm* — Sughrue Mion, PLLC

(57) ABSTRACT

The watch striking mechanism (1) includes at least one gong (11) fixed to a gong-carrier (12) and at least one hammer (2) for activating the vibration of the gong. The striking mechanism includes a first magnetic element (20) in the form of a moving micro-magnet, which is arranged on a striking portion of the hammer, and a second magnetic element (21) in the form of a fixed micro-magnet, which is arranged in one part of the gong. The second magnetic element is at least partly opposite the first magnetic element and is capable of generating a magnetic field of opposite polarity to the magnetic field of the first magnetic element. In a striking mode, said hammer may be driven in the direction of the gong to activate the vibration of said gong via a magnetic impulse due to the repulsion force of the two magnetic elements.

16 Claims, 2 Drawing Sheets

WATCH STRIKING MECHANISM

This application claims priority from European Patent Application No. 10194573.1 filed Dec. 10, 2010, the entire disclosure of which is incorporated herein by reference.

FIELD OF THE INVENTION

The invention concerns a striking mechanism for a watch or possibly a music box. Said mechanism is capable of generating one or several sounds to indicate an alarm or minute repeaters, or a piece of music in the case of a music box.

BACKGROUND OF THE INVENTION

Within the field of watch-making, a conventional architecture is used to make movements, which are provided with striking mechanisms, such as alarms or minute repeaters. In such embodiments, the gong or gongs used are each formed by a metal wire, which is generally circular in shape and placed in a parallel plane to the watch dial. The metal wire of each gong is generally arranged around the movement, in the watch frame and above a plate on which the various parts of the movement are mounted. One end or several ends of each gong are fixed, for example by soldering, to a gong-carrier integral with the plate, for example, which may be common to all of the gongs. The other end of each gong may generally be free.

The watch striking mechanism includes at least one hammer actuated at predetermined times. The vibration of each gong is generated by the impact of the corresponding hammer on the gong, in particular, in proximity to the gong-carrier. Each hammer makes a partial rotation in the plane of the gong(s) so as to strike the corresponding gong and cause it to vibrate in its plane. Part of the gong vibration is also transmitted to the plate by the gong-carrier.

The mechanical impact between the hammer and the gong of a conventional striking mechanism is difficult to control. The same is true for optimization of acoustic efficiency, which is greatly limited within the audible frequency range, particularly within the range of frequencies between 1 kHz and 4 kHz, but also between 4 kHz and 20 kHz. This is due to the fact that the mechanical impact of the hammer against the gong is of very short duration and most of the energy is transmitted at high frequency vibration modes above 4 kHz. The duration of impact of the hammer against the gong generally cannot be increased by altering the geometry, inertia and material of the parts involved, without also causing a marked decrease in the impact energy. Further, mechanical shocks, particularly the impacts of the hammer against the gong, may cause spurious noise, especially in the case of double impact, and lead to wear of gong, which is a drawback.

EP Patent No. 2 048 548, which mainly discloses a hammer for a watch striking mechanism, may be cited in this regard. This hammer includes two parts hinged to each other and a resilient member secured to one of the hinged parts. When the hammer is in a stable position, the resilient spring member holds the two parts of the hammer, whereas when the hammer is in the striking position, the two parts move away from each other, returned by the resilient spring member. This hammer arrangement complicates the making of a striking mechanism, which is a drawback. Further, any mechanical impact of the hammer may also cause spurious noise, which is another drawback.

FR Patent Nos. 2 407 862 and 1 214 428 disclose a striking device for a clock. This striking device includes, in particular, a rotatably mounted hammer, driven by means of an electromagnet in the direction of a bell, to generate a sound during the mechanical impact of the hammer against the bell. As mentioned hereinbefore, any mechanical impact of the hammer against the bell may also cause spurious noise, which is a drawback.

SUMMARY OF THE INVENTION

It is thus an object of the invention to overcome the drawbacks of the state of the art, by providing a watch striking mechanism, which uses a new principle for generating one or several sounds from at least one gong, without any direct mechanical contact of the hammer against the gong in a striking mode.

The invention therefore concerns the aforecited watch striking mechanism for a watch, said striking mechanism including at least one gong secured to a gong-carrier, and at least one hammer for activating the gong to vibrate said gong, characterized in that the striking mechanism includes a first magnetic element arranged on a striking portion of the hammer, and a second magnetic element arranged in a part of the gong, wherein the second magnetic element is at least partly opposite the first magnetic element, and is capable of generating a magnetic field of opposite polarity to the magnetic field of the first magnetic element, and in that in a striking mode, said hammer may be driven in the direction of the gong to activate the vibration of said gong via a magnetic impulse due to a repulsion force of the two magnetic elements.

Specific embodiments of the watch striking mechanism are defined in the dependent claims 2 to 15.

One advantage of the striking mechanism according to the invention lies in the fact that the gong can be struck via a magnetic arrangement without any direct mechanical contact between the hammer and the gong. The magnetic arrangement may consist of providing the gong with at least one fixed permanent magnet, and the striking portion of the hammer with a moving permanent magnet which faces the fixed permanent magnet, but is of opposite magnetic polarity.

Owing to the magnetic arrangement for striking the gong via the hammer without any direct mechanical contact, the duration of the striking impulse may advantageously be increased. This maximises the transfer of energy in the low frequency gong vibration modes, particularly within the frequency range comprised between 1 kHz and 4 kHz. The restitution coefficient is greater with this magnetic arrangement than with a conventional striking mechanism with mechanical shocks. Further, the spurious noise from mechanical shocks is thus eliminated and multiple impulses and the interference therefrom on the gong vibration are also eliminated.

BRIEF DESCRIPTION OF THE DRAWINGS

The objects, advantages and features of the watch striking mechanism will appear more clearly in the following description, particularly with reference to the drawings, in which.

DETAILED DESCRIPTION OF THE INVENTION

In the following description, all the conventional parts of the watch striking mechanism that are well known in this technical field will be only briefly described.

Figure 1:
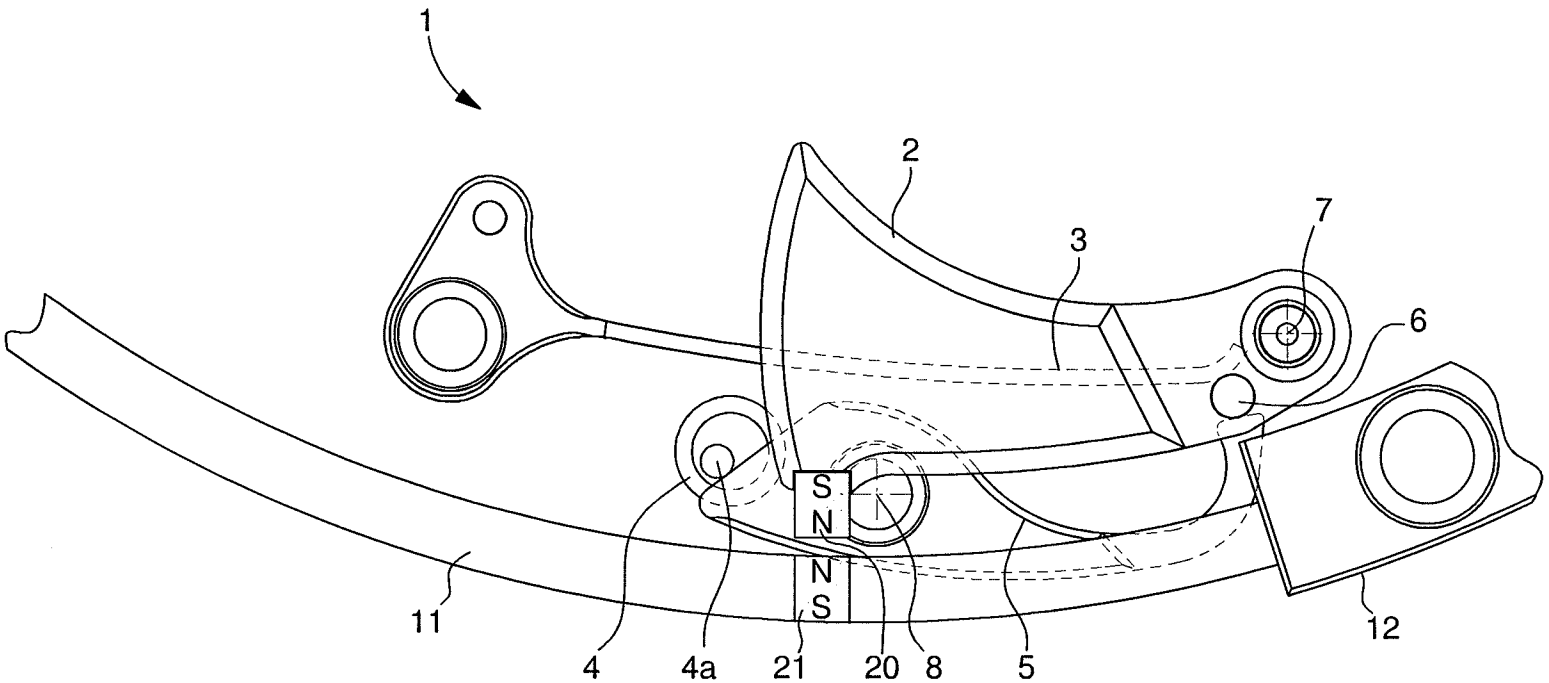
FIG. 1 shows a simplified top view of an embodiment of a watch striking mechanism according to the invention.

FIG. 1 shows a simplified view of a striking mechanism 1 for a striking watch. The striking mechanism 1 essentially includes a gong 11, which is connected, for example, at one end thereof to a gong-carrier 12, whereas the other end is free to move. The gong-carrier may preferably be secured to a plate (not shown) of a watch movement, but it could also be secured to an inner part of the watch case. The striking mechanism also includes a hammer 2 rotatably mounted about an axis 7, for example on the plate in proximity to the gong-carrier. This hammer is for activating said gong 11 to cause it to generate at least one sound, to indicate, for example, the hours, the minutes or a programmed alarm time.

Gong 11 can be made in the form of a portion of a circle, for example by means of a metal wire, generally made of a ferromagnetic material (iron, nickel, steel or cobalt), or also of a precious metal or metallic glass. The portion of a circle conventionally surrounds a part of the watch movement (not shown). This portion of a circle of the gong extends substantially into a parallel plane to the plate and to the watch dial (not shown). The transverse section of the gong 11 may define a rectangle or preferably a disc with a diameter of less than 0.8 mm.

It is to be noted that the gong may also have a different shape from that of a portion of a circle, for example, a rectilinear shape or a rectangular shape.

A striking portion of the hammer advantageously includes a first magnetic element, which may be a moving permanent magnet 20. This moving permanent magnet 20 may advantageously be a micro-magnet. The micro-magnet may be bonded or soldered or inserted in a hollow in the striking portion of the hammer. It may also be made in the material of the striking portion of the hammer by a well known magnetising operation. However, in order to magnetise the striking portion of the hammer, the striking portion must be made of ferromagnetic material.

This striking portion of the hammer, which includes the moving permanent magnet 20, is held at a distance from the gong via a damper spring 5, while a drive spring 3 can be wound to drive said hammer, via a hammer shaft 6, in the direction of the gong to vibrate the latter. Damper spring 5 is rotatably mounted about an arbour 8 secured to the watch plate. An adjustment wheel 4 is also provided, on which a pin 4*a* is placed off-centre. This pin is in contact with one surface of a first cam-shaped end of the damper spring. The other end of damper spring 5 holds hammer 2 in an idle position via shaft 6. The distance, in the idle position, between the striking portion of the hammer and gong 11, may, for example, be adjusted by means of wheel 4 with pin 4*a* in contact with the surface of the first end of damper spring 5.

Gong 11 also includes a second magnetic element, which may be a fixed permanent magnet 21. This fixed permanent magnet may advantageously be a micro-magnet of the same or different dimensions to moving micro-magnet 20 of the hammer. This micro-magnet may also be bonded or soldered to the gong or inserted in a housing made in the gong material. Two parts of the gong may also be soldered to each side of the micro-magnet. The micro-magnet of the gong may also be made directly in the gong material, which must be ferromagnetic, by a well known magnetising operation. The fixed permanent micro-magnet 21 of the gong is arranged at least partly facing the moving permanent micro-magnet 20 of hammer 2, but with opposite magnetic polarity. Preferably, the two micro-magnets are directly opposite each other. This fixed permanent magnet 21 of the gong may also form an inertia-block to increase the density of generated partials and increase the quality factor of the gong.

Since the two micro-magnets 20 and 21 are arranged opposite each other with different polarities, a repulsion force is generated. In this embodiment, the two north poles of the micro-magnets are opposite each other. This repulsion force increases the closer the micro-magnets are to each other. In a striking mode and when hammer 2 drops in the direction of gong 11, a magnetic impulse occurs for generating an acoustic vibration of said gong without any direct mechanical contact between the hammer and the gong. Thus, a transfer of mechanical energy between the hammer and the gong takes place solely by means of a magnetic interaction. This transfer of energy between hammer 2 and gong 11 can thus take place without any mechanical contact between the hammer and the gong.

The duration of the impulse on gong 11 can be optimised independently of the velocity of hammer 2, which is driven by drive spring 3, but by modifying the size of micro-magnets 20, 21 or by using micro-magnets having a different magnetisation. Under these conditions, it is possible to maximise the transfer of energy in the gong vibration modes within the preferred frequency range of between 1 kHz and 4 kHz. When a vibration of gong 11 is generated by a magnetic impulse, any spurious noise due to shocks is eliminated.

The repulsion force between the two permanent micro-magnets 20 and 21 will increase according to the power of 4 of the distance in local approximation. This is confirmed when the two micro-magnets are small relative to the distance that separates them. This means that the two micro-magnets 20, 21 do not come into direct mechanical contact with each other. The repulsion becomes 16 times greater when the distance separating the two micro-magnets is divided by two. Consequently, damper spring 5 is used mainly only to move the hammer a certain distance away from the gong in an idle mode, and not to adjust the transfer of energy during the hammer strike, as in a conventional striking mechanism.

When the striking portion of hammer 2 is at a distance close to 1 μm for vibrating the gong, the magnetic force may be on the order of 1 N. Normally, the distance separating hammer 2 from gong 11, when the hammer strikes, may be on the order of 5 μm or more, to generate a sufficient gong vibration. These permanent micro-magnets may be made with a size of 1 $mm^3$ or less, generating a magnetic field of less than 1200 Gauss. When the hammer is in an idle position, the distance separating the striking portion of hammer 2 from gong 11 may be less than 0.3 mm, adjusted by damper spring 5.

Figure 2:
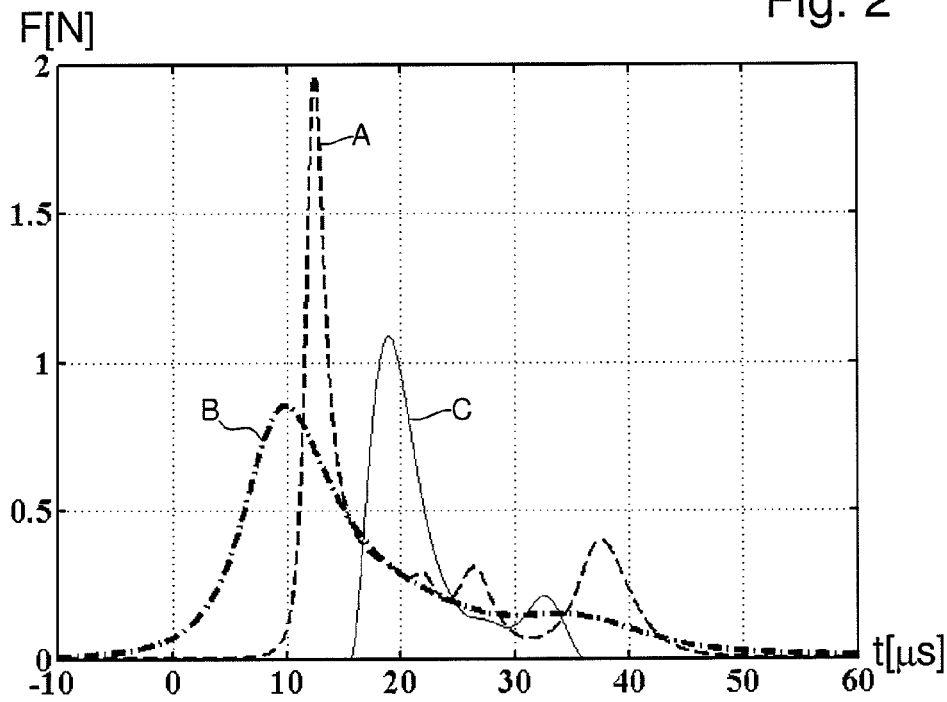
FIG. 2 shows a comparative graph of the force applied to the gong relative to the duration of the impulse during a mechanical strike of the hammer against the gong and when a magnetic force is generated by a striking mechanism.
Figure 3:
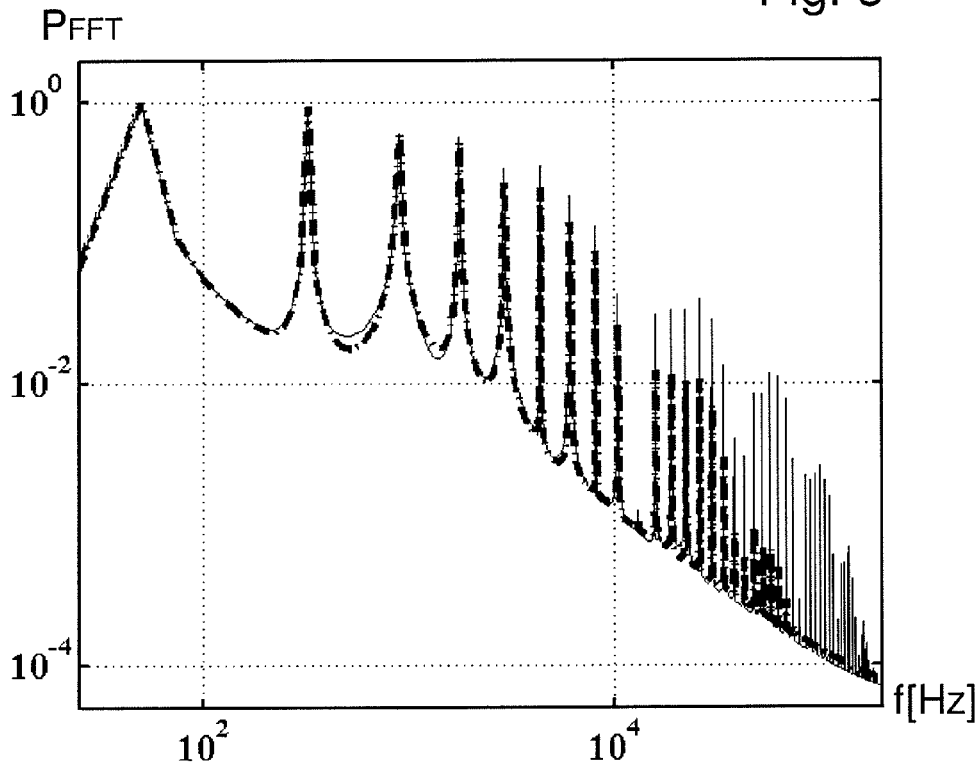
FIG. 3 shows a comparative graph of the amplitude of the gong vibration partials generated by mechanical impact or by a magnetic force according to the oscillation frequency.

Reference can be made to FIGS. 2 and 3 for a comparison between a conventional striking mechanism and the striking mechanism of the present invention, FIG. 2 shows the graph of the force acting on the gong according to the duration of the impulse when the hammer strikes, for a conventional striking mechanism and for a striking mechanism according to the invention. For this comparative graph, the two micro-magnets have the same permanent magnetisation with a first magnetisation value m1 for curve A and a second magnetisation value m2 for curve B. The second magnetisation value m2 is greater than the first magnetisation value m1. Curve C represents the force when there is a mechanical shock of the hammer against the gong in the striking mode.

The initial speed of the hammer, the drive spring and the damper spring are identical for the purposes of this comparison. In the case of a conventional striking mechanism with a mechanical shock, the force is exerted when there is contact between the hammer and the gong. The duration of the impulse is very short. In the case of the magnetic arrangement of the striking mechanism according to the invention, the force acts remotely and the impulse which results therefrom is of longer duration. The total energy transferred is also greater relative to the conventional striking mechanism. By increasing the magnetisation value of the micro-magnets, it is possible to increase the duration of the magnetic impulse.

FIG. 3 shows the amplitude of the partials following a quick Fourier transform according to the oscillation frequency of the gong, for a conventional striking mechanism and for a striking mechanism according to the invention. The curve in dotted lines represents the magnetic impulse, whereas the curve in full lines represents a mechanical shock. The gong vibrations are formed of partials, which are produced either by the mechanical shock to the gong, or by the magnetic impulse. The magnetic impulse used represents a magnetisation value m2 of the micro-magnets, as mentioned with reference to FIG. 2. The high frequency components, in particular higher than 20 kHz, are reduced in the case of a magnetic impulse compared to a mechanical shock. The relative energy contained in the modes between 1 kHz and 4 kHz corresponds to 40% of the total energy transferred in the case of a conventional mechanical shock, and to 55% of the total energy transferred in the case of a magnetic shock. This clearly shows that the transfer of energy in the low frequency gong vibration modes is maximised with the magnetic arrangement of the striking mechanism of the invention. Any spurious noise is also eliminated.

In an embodiment that is not shown, it is also possible to envisage arranging two or more moving permanent micro-magnets on the striking portion of the hammer, and two or more permanent micro-magnets on the gong at least partly facing two of the micro-magnets of the hammer. In the case of two moving micro-magnets on the hammer, the two fixed micro-magnets of the gong are respectively opposite each micro-magnet of the striking portion of the hammer, but with opposite magnetic polarity. The south pole of one of the hammer micro-magnets may be facing the south pole of one of the gong micro-magnets, whereas the north pole of the other hammer micro-magnet may be facing the north pole of the other gong micro-magnet. It is also possible to envisage only one of the north or south poles of the hammer micro-magnets facing the north or south poles of the moving gong micro-magnets in order to generate a repulsion force.

Instead of using permanent micro-magnets, it is also possible to envisage having a coil, which can be connected to a continuous current to generate a magnetic field of determined polarity, as the magnetic element on the hammer and/or on the gong. Each coil may also be arranged to be disconnected from the continuous current source in an idle mode of the striking mechanism.

From the description that has just been given, several variants of the watch striking mechanism can be devised by those skilled in the art without departing from the scope of the invention defined by the claims. A median part of the gong may be secured to a gong-carrier integral with the plate or the middle part of the watch. The hammer may also be mounted on the middle part of the watch. The hammer may also be actuated in translation with its micro-magnet in a perpendicular direction to the gong micro-magnet so as to vibrate said gong in a striking mode. The striking mechanism may include several gongs each activated by a respective hammer via a magnetic arrangement. A permanent magnet may be arranged on the hammer opposite a magnetic element of the gong, which is in the form of a coil through which a continuous current passes to generate a magnetic field of opposite polarity to the permanent magnet of the hammer. Conversely, a permanent magnet may be provided on the gong and a magnetic element on the hammer, which is in the form of a coil through which a continuous current passes to generate a magnetic field of opposite polarity to the permanent magnet of the gong. Two permanent magnets may also be provided on the gong or the hammer partly facing a permanent magnet of opposite polarity on the hammer or the gong.

What is claimed is:

1. A striking mechanism for a watch, said striking mechanism including at least one gong secured to a gong-carrier, and at least one hammer for activating the gong to vibrate said gong, wherein the striking mechanism includes a first magnetic element arranged on a striking portion of the hammer, and a second magnetic element arranged in a part of the gong, wherein the second magnetic element is at least partly opposite the first magnetic element, and is capable of generating a magnetic field of opposite polarity to the magnetic field of the first magnetic element, and wherein in a striking mode, said hammer may be driven in the direction of the gong to activate the vibration of said gong via a magnetic impulse due to a repulsion force of the two magnetic elements.

2. The striking mechanism according to claim 1, wherein the first magnetic element of the hammer is a moving permanent magnet.

3. The striking mechanism according to claim 2, wherein the moving permanent magnet is a moving micro-magnet.

4. The striking mechanism according to claim 1, wherein the second magnetic element of the gong is a fixed permanent magnet.

5. The striking mechanism according to claim 4, wherein the fixed permanent magnet is a fixed micro-magnet.

6. The striking mechanism according to claim 1, wherein the first magnetic element is a coil capable of being connected to a continuous current source to generate a magnetic field of determined opposite polarity to the magnetic field generated by the second magnetic element.

7. The striking mechanism according to claim 1, wherein the second magnetic element is a coil capable of being connected to a continuous current source in order to generate a magnetic field of determined opposite polarity to the magnetic field generated by the first magnetic element.

8. The striking mechanism according to claim 1, wherein the hammer is held at a distance from the gong via a damper spring, and wherein the hammer is driven in the direction of the gong in a striking mode via a pre-wound drive spring.

9. The striking mechanism according to claim 1, wherein the gong defines at least one portion of a circle or one portion of a rectangle around a watch movement inside a case of said watch, wherein a first end of the gong is secured to the gong-carrier, whereas a second end is free to move, wherein the second magnetic element of the gong is arranged in proximity to the gong-carrier, and wherein the first magnetic element of the hammer is arranged, in an idle mode, opposite to and at a distance from the second magnetic element of the gong.

10. The striking mechanism according to claim 1, wherein the striking portion of the hammer includes at least two magnetic elements in the form of micro-magnets at least partly facing a second magnetic element in the form of a fixed micro-magnet of the gong.

11. The striking mechanism according to claim 1, wherein the gong includes at least two second magnetic elements, in the form of micro-magnets which at least partly face a first magnetic element in the form of a moving micro-magnet of the hammer.

12. The striking mechanism according to claim 1, wherein it includes several gongs arranged without any contact one above the other, one end of each gong being secured to the same gong-carrier or to several respective gong-carriers, each gong being able to be activated by a respective hammer to vibrate, and wherein each gong includes at least one second magnetic element, capable of generating a magnetic field of opposite polarity to each first magnetic element arranged on a striking portion of the respective hammer.

13. The striking mechanism according to claim 3, wherein the moving micro-magnet is bonded or soldered to, or inserted in a housing in the striking portion of the hammer.

14. The striking mechanism according to claim 5, wherein the fixed micro-magnet is bonded or soldered to, or inserted in a housing in a part of the gong.

15. The striking mechanism according to claim 3, wherein the micro-magnets are made by a magnetising operation in a ferromagnetic material of the striking portion of the hammer or of one part of the gong.

16. The striking mechanism according to claim 5, wherein the micro-magnets are made by a magnetising operation in a ferromagnetic material of the striking portion of the hammer or of one part of the gong.

* * * * *